US007866472B2

(12) United States Patent
Aylward

(10) Patent No.: US 7,866,472 B2
(45) Date of Patent: Jan. 11, 2011

(54) GREETING DEVICE

(76) Inventor: Karen Aylward, 1 Chapel Close, Ellesmere Port, Cheshire, CH65 2HP (GB)

( * ) Notice: Subject to any disclaimer, the term of this patent is extended or adjusted under 35 U.S.C. 154(b) by 1289 days.

(21) Appl. No.: 10/542,795

(22) PCT Filed: Jan. 21, 2004

(86) PCT No.: PCT/GB2004/000177

§ 371 (c)(1),
(2), (4) Date: Mar. 17, 2006

(87) PCT Pub. No.: WO2004/065263

PCT Pub. Date: Aug. 5, 2004

(65) Prior Publication Data

US 2006/0157356 A1 Jul. 20, 2006

(30) Foreign Application Priority Data

Jan. 22, 2003 (GB) ..... 0301400.8

(51) Int. Cl.
*B65D 73/00* (2006.01)

(52) U.S. Cl. ..... 206/457; 206/232; 206/395; 206/225; 229/116.1

(58) Field of Classification Search ..... 206/38, 206/457, 459.5, 232, 389, 395, 575, 771, 206/774, 773, 769, 781, 775, 783, 225, 831; 229/116.1; 40/124.06, 312, 313
See application file for complete search history.

(56) References Cited

U.S. PATENT DOCUMENTS 1,194,618 A * 8/1916 Gottschalk ..... 281/6
1,804,152 A * 5/1931 Cowan ..... 206/526
2,188,615 A * 1/1940 Slezak ..... 283/117
2,491,619 A 12/1949 Lund et al.
2,850,156 A * 9/1958 Shane ..... 206/575
3,256,978 A * 6/1966 Srigley et al. ..... 206/232
3,497,057 A * 2/1970 Traner et al. ..... 206/730
4,022,318 A * 5/1977 Goodman ..... 206/223
4,358,013 A * 11/1982 Shebley ..... 206/391
4,537,366 A * 8/1985 Swenson et al. ..... 242/137
4,577,753 A * 3/1986 Marhal ..... 206/232
4,620,664 A * 11/1986 Kaufman et al. ..... 229/233
4,842,140 A * 6/1989 Mesnard ..... 206/457
5,265,727 A * 11/1993 Anderson ..... 206/457
5,503,274 A * 4/1996 Toffler et al. ..... 206/457
5,582,293 A * 12/1996 Kay ..... 206/457
5,641,062 A 6/1997 Burton et al.

(Continued)

FOREIGN PATENT DOCUMENTS

GB 659186 10/1951

*Primary Examiner*—David T Fidei
(74) *Attorney, Agent, or Firm*—Gerald E. Hespos; Michael J. Porco

(57) ABSTRACT

A combined greeting and gift set comprising a greetings scroll (10) carrying printed matter and having a region for the insertion of a personal message by the user, means (14) to maintain the scroll in its rolled/up condition, a container (18) for housing the scroll and at least one gift (22), the container being at least partially transparent to enable the scroll (10) and gift (22) to be seen from the outside of the container (18) and having access means (32*d*, 32*e*) enabling the scroll (10) to be selectively removed and returned to the container (18) without disturbing the gift or gifts (22).

21 Claims, 5 Drawing Sheets

U.S. PATENT DOCUMENTS 5,836,095 A * 11/1998 Crowell ..... 40/299.01
5,950,820 A * 9/1999 Heinze, IIII ..... 206/232
6,092,658 A * 7/2000 Pietrafesa ..... 206/457
6,095,331 A * 8/2000 Cressman ..... 206/457
6,216,856 B1 * 4/2001 Park ..... 206/214
6,301,812 B1 10/2001 Klunk
6,328,157 B1 * 12/2001 Tolver ..... 206/216
6,371,366 B1 * 4/2002 Edgerton et al. ..... 229/162.3
D489,604 S * 5/2004 Turner ..... D9/718
2002/0162881 A1 * 11/2002 Umanoff ..... 229/89

* cited by examiner

GREETING DEVICE

BACKGROUND OF THE INVENTION

1. Field of the Invention

The present invention relates to a greeting device.

2. Description of the Related Art

It is common custom throughout the world to give gifts and cards to family and friends. In many cases, for example if the recipient lives some distance away, the person giving the gift and card may send them via the postal service.

Buying a card and gift separately is both time consuming and expensive, perhaps requiring various outlets to be visited to enable a compatible card and gift to be acquired. When found, the gift needs to be wrapped in paper and ribbon, placed in a suitable container to send through the post, which often will not guarantee damage whilst in transit.

Furthermore, in the UK and other countries, the postal service segregates parcels and letters, usually necessitating the card being sent separately to the gift and the two items then often being delivered at different times.

One object of the present invention is to combine a greeting card and a gift in a convenient manner and in a common packaging such as to be clearly visible from the outside and to be suitably decorated in its own right, so as not to need any additional paper or ribbon.

SUMMARY OF THE INVENTION

In accordance with a first aspect of the present invention there is provided a combined greeting and gift set comprising a greetings scroll carrying printed matter and having a region for the insertion of a personal message by the user, means to maintain the scroll in its rolled-up condition, a container for housing the scroll and at least one gift, the container being at least partially transparent to enable the scroll and gift to be seen from the outside of the container and having access means enabling the scroll to be selectively removed and returned to the container without disturbing the gift or gifts.

In one embodiment, the container is formed with separate internal compartments for the scroll and for the or each gift, said access means comprising a raisable flap or a hinged door formed in a wall of its container which enables access to the scroll compartment but not to the gift compartment or compartments.

In one preferred embodiment the container is of elongate rectangular configuration and defines a separate gift compartment at each end of a longitudinally extending scroll-containing compartment. Preferably the gift compartments can be accessed from the ends of the container or via further flaps in side or front walls. The container can be formed from transparent plastics sheet containing cuts, or perforations, forming the liftable flap which enables access to the scroll compartment.

In another embodiment, the container houses a plurality of gifts such as chocolates and the base of the container has an aperture to enable the scroll to be selectively removed from, and replaced to, a position amongst or adjacent the gifts in the container.

The gifts may be chocolates or anything that can be housed within the gift compartment(s), including small novelty devices and jewellery.

In some cases the scroll can be mounted on a plinth, preferably formed of stiff paper, cardboard or a plastics material.

The scroll is preferably of paper, parchment or card printed with a greeting that can be seen when the scroll is rolled-up and one or more regions receiving personal messages which are not normally viewable when the scroll is rolled up.

The scroll is held in its rolled up condition by a ring which can slide along the scroll to avoid obscuring the printed message and for enabling the scroll to be unravelled and re-rolled. Although the ring can be round or indeed any convenient shape, it can be advantageous for it to have a square, triangular or octagonal shape to assist in preventing the scroll from rolling and thereby possibly obscuring the message. When the ring is round, rolling of the scroll in this manner can be prevented either by decoration forming part of or attached to the ring, or by the use of one or more projections on the ring acting as anti-rotation means.

Suitable decoration can be associated with the scroll ring if desired.

The hinged door/flap preferably has an opening-inhibiting means.

In some preferred embodiments, the external shape of the container relates to the gift or gifts inside.

A pull-out card is preferably provided on the container, usually at the rear, which has a pull-out tab to assist in enabling it to be selectively withdrawn for name insertion, thereby enabling the recipient to be identified.

In accordance with a first aspect of the present invention there is provided a greeting device comprising a greetings scroll carrying printed matter and having a region of the insertion of a personal message by the user, means to maintain the scroll in its rolled-up condition, a container for housing the scroll, the container being at least partially transparent to enable the scroll to be seen from the outside of the container, a pull-out card which is normally housed within a pocket or recess in the container but which can be selectively withdrawn to enable writing to be applied thereto, for example to enable the recipient of the greeting device to be identified.

Preferably, the pull-out card has a pull-out tab to assist in enabling it to be withdrawn from its pocket or recess in the container.

BREIF DESCRIPTION OF DRAWINGS

The invention is described further hereinafter, by way of example only, with reference to the accompanying drawings, in which.

DETAILED DESCRIPTION OF THE PREFERRED EMBODIMENTS

Figure 1:
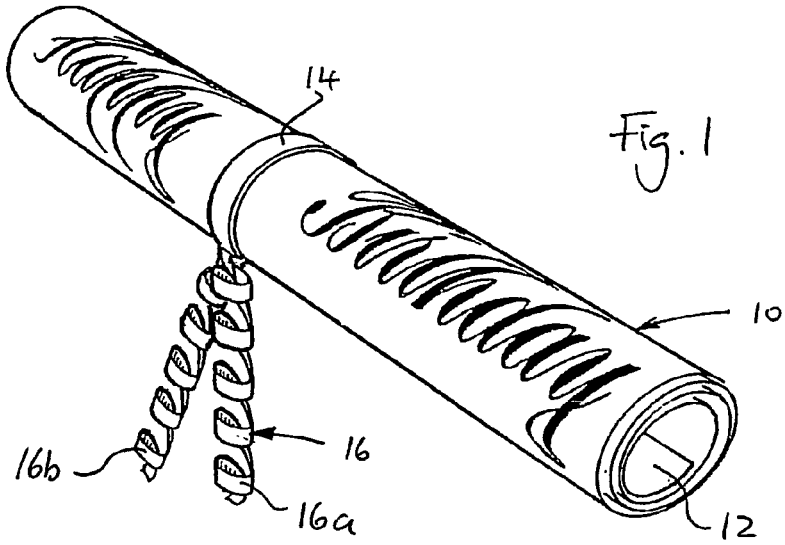
FIG. 1 is a perspective view of one embodiment of a scroll for use with the present invention.

Referring first to FIG. 1, there is shown a scroll 10 which has two main functions, firstly to provide a visible indication of a special occasion being celebrated, eg. HAPPY BIRTHDAY, HAPPY ANNIVERSARY, HAPPY CHRISTMAS . . . EASTER, VALENTINES DAY, WEDDING, ENGAGEMENT ETC., and secondly to enable the sender to write a personal message to the recipient. The scroll may also contain other printed matter such as a poem and/or appropriate decoration and graphics or a wedding invitation with details of event dates, times, etc., with "to" and "from" on the pull-out card.

Normally, the scroll would be in the form of a rolled-up paper, parchment or card sheet 12 but it could be of any suitable "rollable" material. In a typical case, the sheet 12 might be approximately 20×15 cms in size but in practice the dimensions are entirely optional.

Advantageously, the sheet 12 forming the scroll 10 is provided with a means for maintaining the scroll in its rolled up configuration, such as by a suitable ring 14. The position of the ring 14 along the rolled-up sheet is preferably adjustable so that it can be positioned appropriately along the scroll in relation to any words printed thereon eg. HAPPY BIRTHDAY in the illustrated embodiment.

In the embodiment of FIG. 1 the ring 14 is simply formed by knotting a length of ribbon 16 around the rolled-up sheet, with the two ends of the ribbon being stretched so as to form respective curled portions 16*a*, 16*b*.

Figure 2:
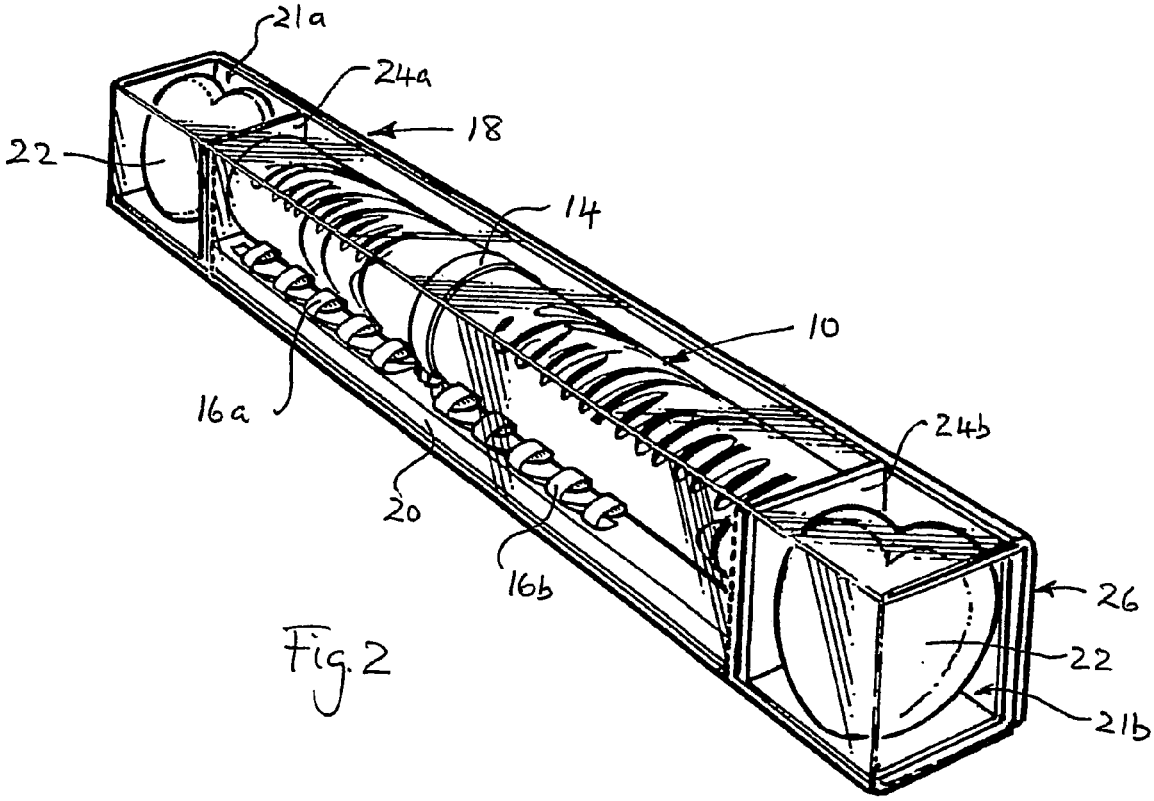
FIG. 2 is a perspective view from above and one end of one embodiment of a complete scroll and gift set in accordance with the invention.

In the embodiment of FIG. 2, the scroll 10 of FIG. 1 is mounted in an elongate transparent, rectangular container 18 formed basically from stiff (but flexible), transparent plastics sheet. The scroll 10 is mounted on an elongate plinth 20 made from folded cardboard or a plastics moulding within a first inner compartment of the container. This embodiment has two further separate inner compartments 21*a*, 21*b* which hold respective gifts, in this case heart-shaped chocolates 22. The central scroll compartment is separated from the two gift compartments by respective divider walls 24*a*, 24*b*, in the illustrated example formed integrally with the folded cardboard plinth 20.

Figure 8:
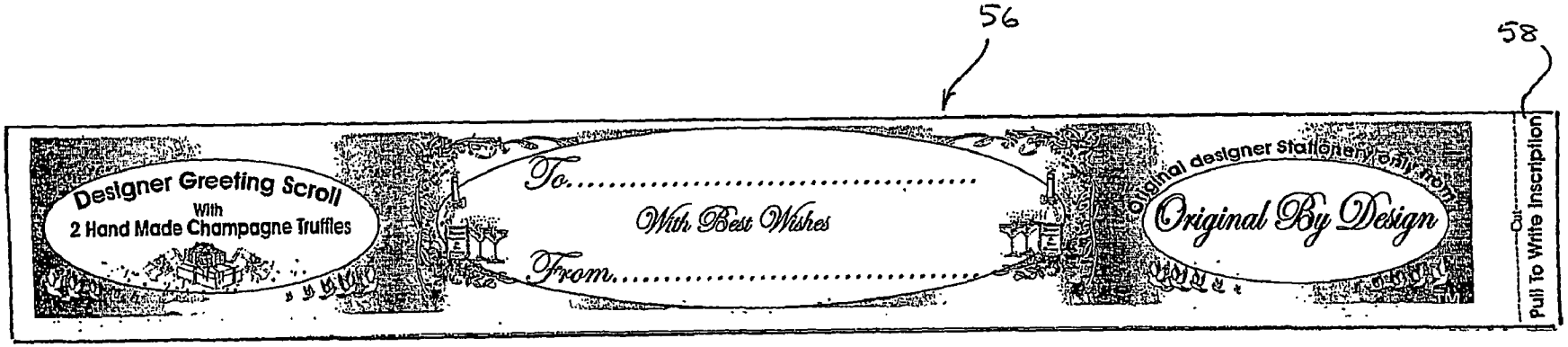
FIG. 8 is a front view of one embodiment of a pull-out card.

The rear wall 26 of the container can be formed with a longitudinal pocket for receiving a pull-out card 56 (see FIG. 8) on which the sender can, if desired, add another greeting, for example "To . . . with best wishes From . . . " The pull-out card preferably has a pull-tab to assist 58 in it being easily gripped. In the embodiment of FIG. 2, for example, the pocket for receiving the card 56 can be formed by the available space between the container panel 32*b* and the upright wall portion 30*c* of the cardboard structure 28, this space being accessible from either end of the container as indicated for example by the arrows A at the right hand side of FIG. 5, whereby the written material on the card 56 is visible through the transparent rear surface of the container formed by the panel 32*b*.

As will be explained hereinafter, the container is formed so that it is possible to open the part of the container 18 housing the scroll 10 to enable the scroll to be selectively removed and returned, whereby to enable the sender to withdraw and personalise the scroll in some way, for example by signing it and/or adding an appropriate message, before it is returned to the container and despatched to the recipient.

Figure 3:
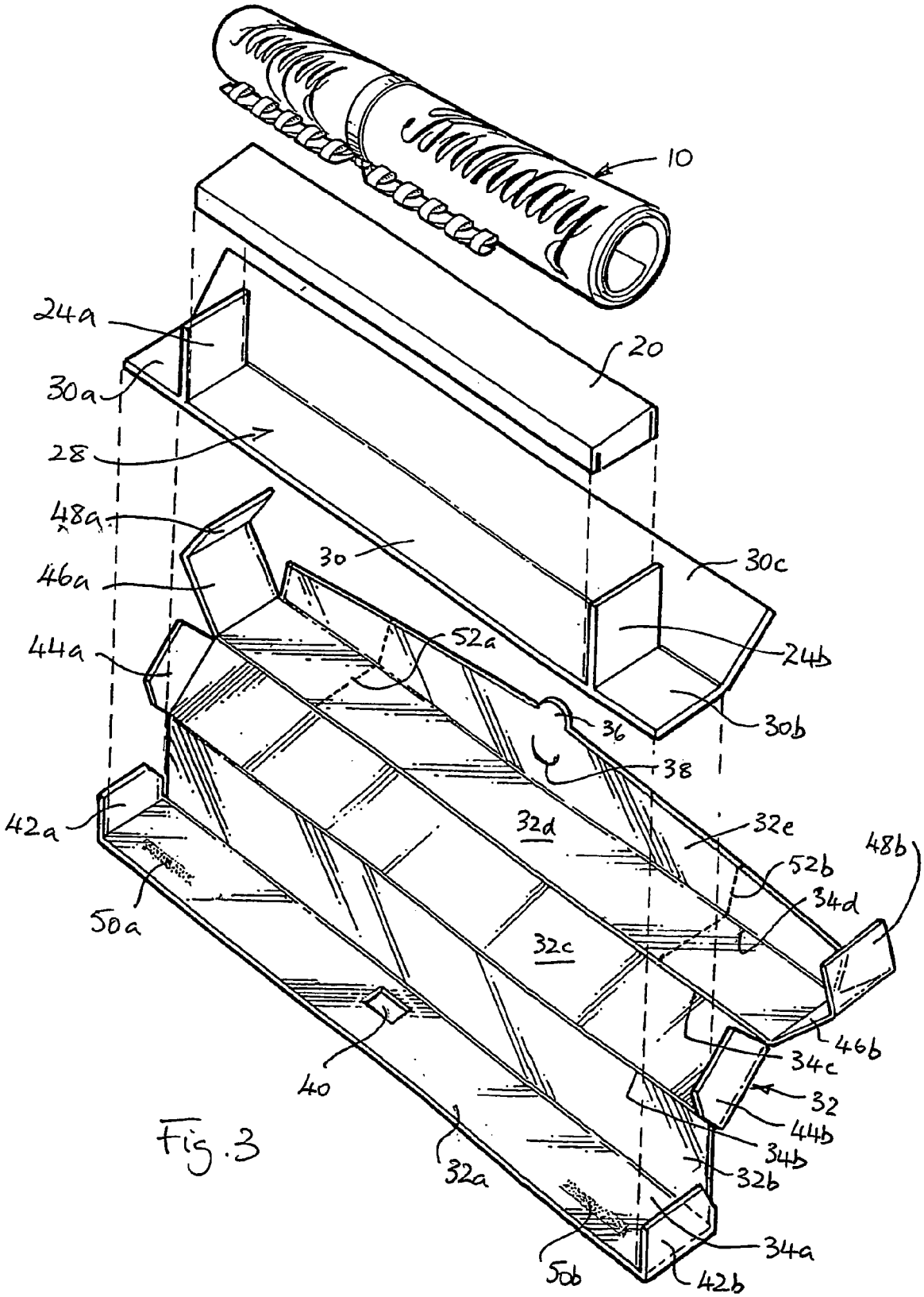
FIG. 3 is an exploded perspective view showing the compartments of the scroll and gift set of FIG. 2 prior to assembly.

FIG. 3 shows the components of the product of FIG. 2 in an exploded view for the purposes of illustration.

The plinth 20 is formed with an inverted box shape and sits above a further folded cardboard structure 28 which defines a base portion 30 from which the two upright divider walls 24*a*, 24*b* extend. Outboard of the walls 24*a*, 24*b*, the base portion is extended to provide end portions 30*a*, 30*b* forming the floors of the two second compartments 21*a*, 21*b*. The structure 28 further comprises an upright rear wall portion 30*c* which extends along the whole length of the container 18.

A plastics blank for forming the main body of the container 18 is indicated in FIG. 3 by the reference numeral 32. The blank 32 is divided longitudinally into five main panels 32*a*, 32*b*, 32*c*, 32*d*, 32*e* by four parallel longitudinally extending fold lines 34*a*, 34*b*, 34*c*, 34*d*. The panels 32*a*-32*d* are rectangular whilst the panel 32*e* is cut back to define a central tongue portion 36. The panel 32*e* has a semi-circular slot 38 for engaging with a rectangular aperture 40 in the panel 32*a* as described further hereinafter. The panels 32*a* and 32*c* carry single ended flaps 42*a*, 42*b* and 44*a*, 44*b*, respectively whilst the panel 32*d* carries double ended flaps 46*a*, 48*a* and 46*b*, 48*b*. Panel 32*a* is provided with adhesive portions 50*a*, 50*b* and panels 32*d*, 32*e* are provided with easily tearable lines of weakness as shown in FIG. 3 by chain lines 52*a*, 52*b*. Alternatively, these lines of weakness can actually be cut from the start.

Figure 4:
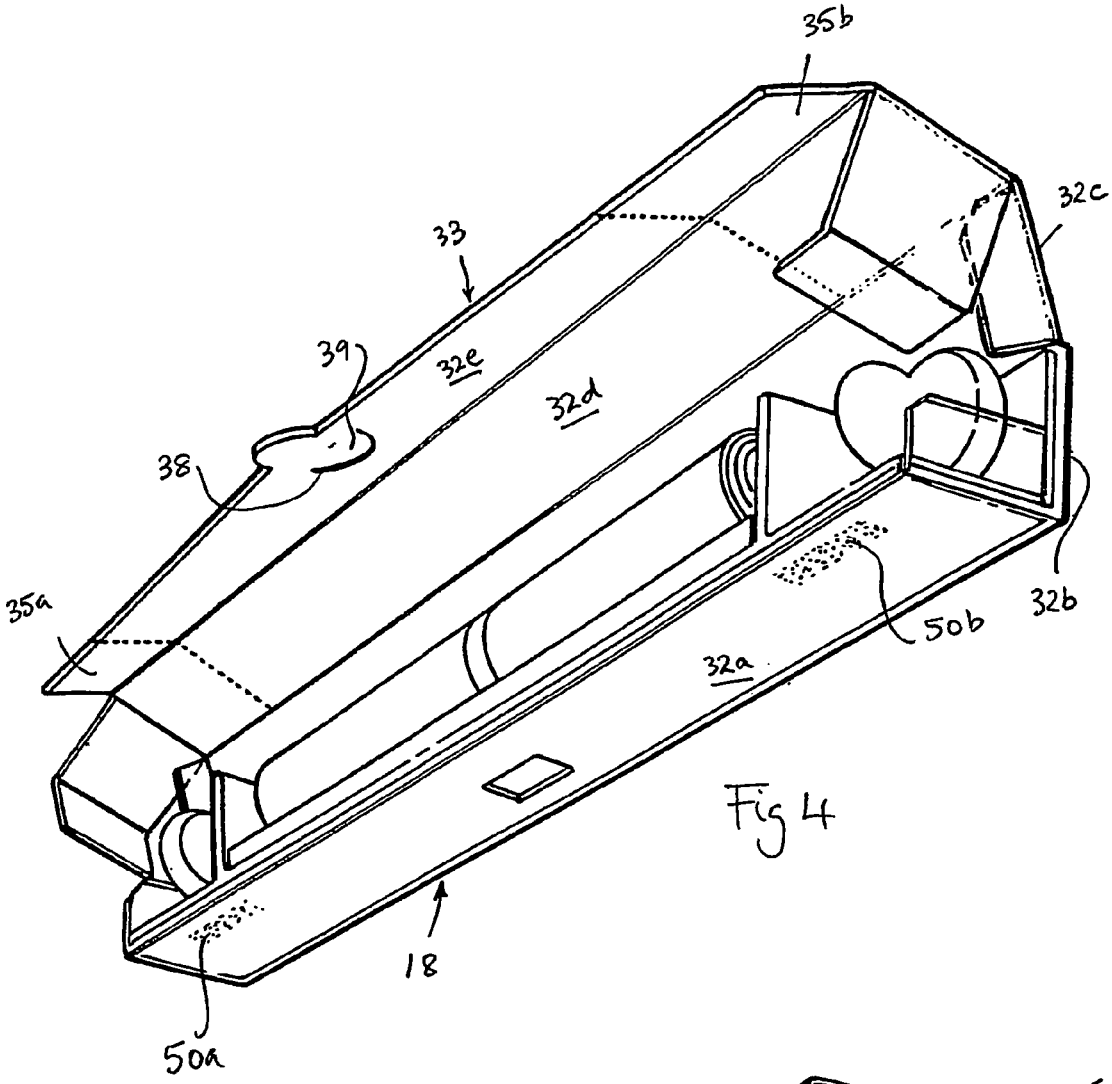
FIG. 4 is a perspective view from below and one end showing the scroll and gift set of FIG. 2 in a partially formed state.

FIG. 4 shows the container 18 in the course of being assembled around the plinth, scroll and gifts. Panel 32*a* forms the base wall of the container, the panel 32*b* forms the rear wall of the container, panel 32*c* forms the top wall of the container, panel 32*d* forms the front wall of the container and panel 32*e* forms a closure part 33 that normally lies beneath the container, with the semi-circular tongue 39 defined by the slot 38 engaging within the aperture 40. The adhesive portions 50*a*, 50*b* engage and adhere to end portions 35*a*, 35*b* of the flap 32*e* as best seen in FIG. 5 in order to hold the container in its assembled format with the end flaps 44*a*, 48*b* being tucked in, over the end flaps 42*a*, 42*b* and 44*a*, 44*b*, against the wall 32*a* to close the container ends.

Figure 5:
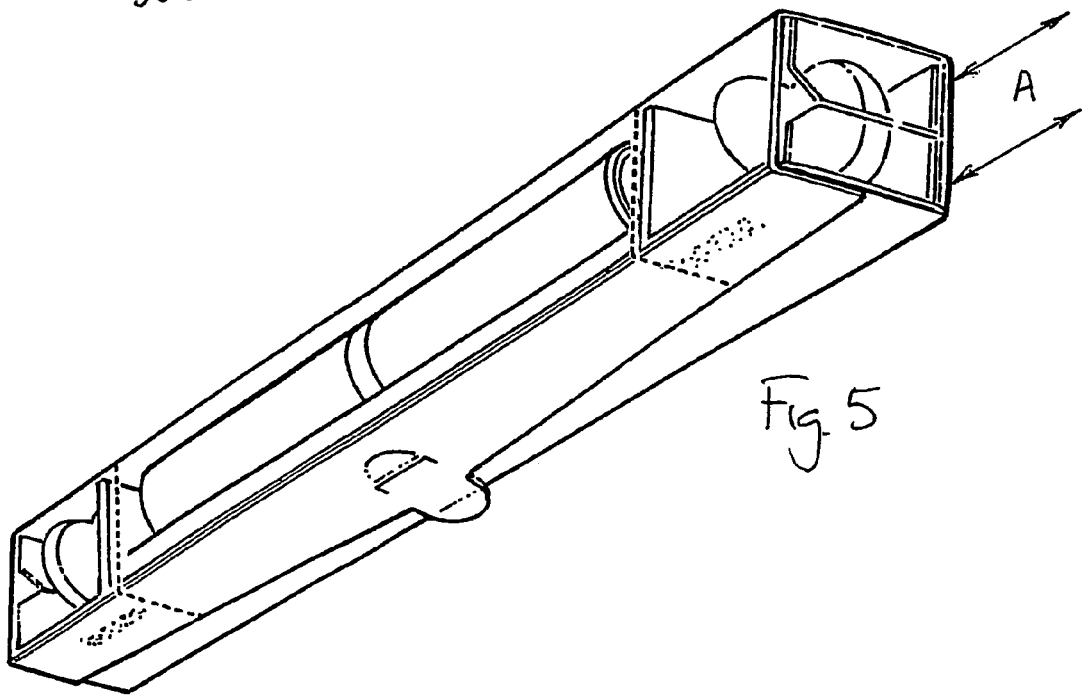
FIG. 5 is a perspective view from below and one end showing the scroll and gift set of FIG. 2 in a fully formed closed condition.

Thus, in its closed state, the container 18 is as shown in FIG. 5, with the scroll and the chocolates in place and the tongue 39 on the closure flap 32*e* engaged in the aperture 40.

Figure 7:
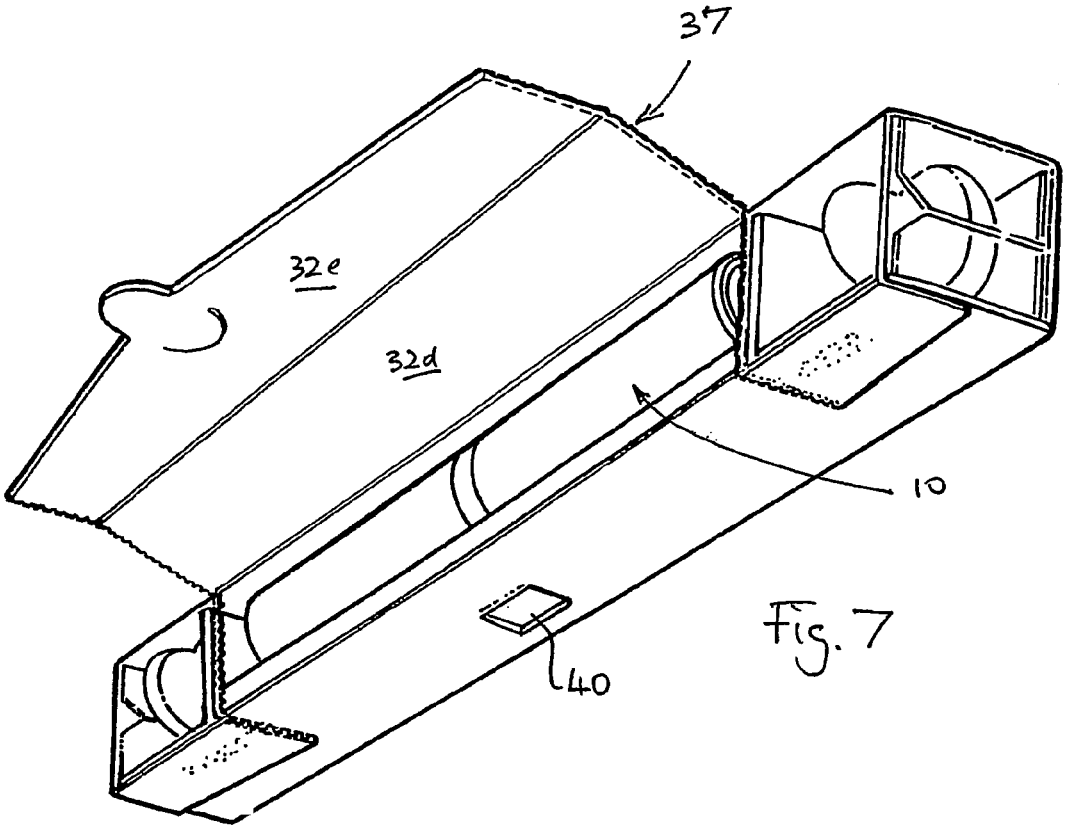
FIG. 7 is a perspective view from below and one end of a modified scroll and gift set.

In order to gain access to the scroll without having to disturb the chocolates, the tongue 38 can be disengaged from the aperture 40 and a central part of the panels 32*d* and 32*e* lifted whereby to tear the weakened portions 52*a*, 52*b* and form a flap 37 from these two panels 32*d*, 32*e* which can be raised to the position shown in FIG. 7. Obviously, if the weakened portion is replaced by permanent cuts, then the flap 37 can simply be lifted to the FIG. 7 position without any tearing being necessary. Either way, access is enabled to the scroll via the open flap 37 so that the scroll can be removed for the purposes of personalisation before being replaced and the flap 37 being returned to its closed position shown in FIG. 5.

Figure 6:
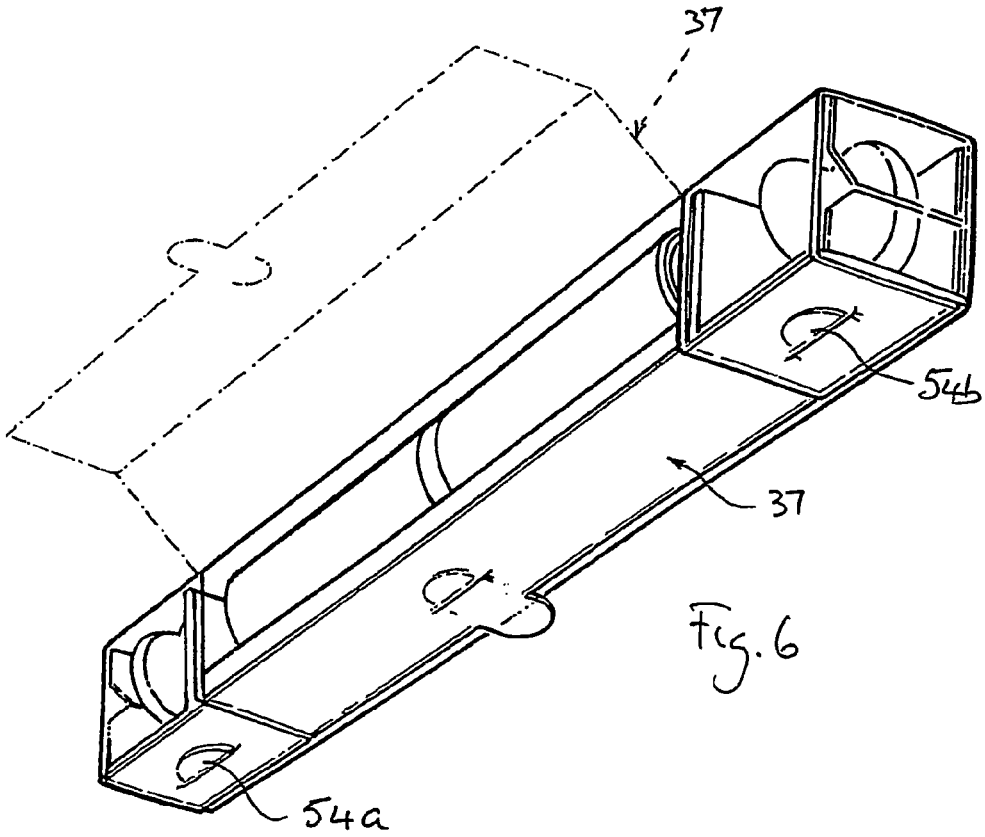
FIG. 6 is a perspective view from below and one end showing the assembled scroll and gift set of FIG. 2 with the releasable flap open to enable access to the scroll.

FIG. 6 shows a slightly modified embodiment in which, instead of using the adhesive portion 50*a*, 50*b*, additional tongue and slot arrangements 54*a*, 54*b* are provided which enable selective access to the chocolate without disturbing the scroll or opening the end flaps of the container.

The shape and nature of the gifts, in this case the chocolates, is of course not limited to that shown and capable of infinite variation.

Other embodiments may have completely differently shaped containers, housing completely different gifts in completely different numbers—provided that the scroll can be accessed separately, without disturbing the gifts.

For example, another embodiment could comprise a container housing horizontal rows and columns of chocolates or other sweets, under a transparent plastics cover. A base of the container, providing support for the chocolates, can have an aperture for receiving a scroll (eg. as shown in FIG. 1) supported on a removable portion of the base. In this case the scroll, which sits normally in amongst or to one side of the chocolates can be removed from the container, without disturbing the chocolates, by withdrawing said removable part of the base supporting the scroll through the aperture in the container base.

In this embodiment also, a further greeting/message card can, if desired, be located in a withdrawable manner in a slot/recess at one end of the container.

In other embodiments, the ring 14 can be a plain circular ring made of metal, metallised plastics or plastics material. In some embodiments, the ring 14 can be provided with an attachment for enabling the ring to be coupled to decorative "strings", eg. as shown in FIG. 1 at 16*a*, 16*b*.

The attachment can conveniently be in the form of a small "T" piece, which can be received in an elongate, longitudinal slot in the plinth to hold the scroll in place and in a required orientation for correctly displaying the printed message thereon, eg. HAPPY BIRTHDAY.

When displaying the product, eg. as shown in FIG. 2 for sale in a shop, the product can be displayed in a box on which the verse(s) inside the scroll can be written for the benefit of the purchaser.

To enable the combined scroll and gift to be sent safely through the post without danger of damage thereto it is normally sold with a matching cardboard or corrugated paper box in which it can be snugly fitted and which provides a substantially rigid support during transit. Thus, in the case of the embodiment of FIG. 2, the packaging box would also be of rectangular cuboidal configuration with an inner cavity just capable of receiving the container 18.

As mentioned hereinbefore, the shape of the container 18 is capable of infinite variation and could include for example a Christmas cracker shape, an Easter egg shape, a cylinder shape, triangular or a perfume bottle shape. In each case, the "gift" can be chosen to suit the occasion and the shape of the containers, eg. Easter egg, perfume etc. In each case the postal packaging could be shaped to conform to the shape of the container.

In a further alternative embodiment, the cardboard plinth and the cardboard base and divider walls of the FIG. 2 embodiment can be formed as a one-piece moulding, for example of cardboard or a plastics material.

In some cases the pull-out card can be supplemented or replaced by printing wording directly on an outer face or faces of the container or by the application of a sticker-type label, for example on the outer surface of the container panel 32*b*. As before the information printed on the sticker can be, for example, an invitation, thank you, wedding favor, etc.

A removable sticker may also be applied to the outer part of the container to show to a potential purchaser a verse that is carried by the rolled-up scroll. The sticker would then normally be removed before sending the greeting device on to an intended recipient.

In some cases, the product will be provided to the retailer with the gifts in place in the container. However in other cases, the product can be supplied to the retailer without gifts in place, the intention being that the gifts can be selected separately at the point of sale by the purchaser. For example, in addition to sweets, the gifts could be other small novelty items or perhaps jewellery.

In still further embodiments, the container may house just the scroll and no gifts at all. In this case the end compartments 21*a*, 21*b* for receiving the gifts would not be present. However, the pull-out card would still be present, housed in the pocket or recess in the container as before. Thus, the container would have a first compartment for receiving the scroll and a second compartment for receiving the pull-out card whereby both the scroll and pull-out card can be accessed separately.

As before, the container can be of any shape in this latter embodiment.

The invention claimed is:

1. A combined greeting and gift set comprising a greetings scroll carrying printed matter and having a region for the insertion of a personal message by a user, means for releasably maintaining the scroll in a rolled-up condition and enabling the scroll to be unraveled and re-rolled, a container for housing the scroll and at least one gift, the container being at least partially transparent to enable the scroll and the gift to be seen from outside the container, the container having a wall with access means for enabling the scroll to be selectively removed and returned to the container without displacing the gift.

2. A combined greeting and gift set as claimed in claim 1 wherein the container is formed with an internal scroll compartment for the scroll and an internal gift compartment for the gift, the gift compartment being separate from the scroll compartment, and said access means is formed in a wall of the scroll compartment of the container which enables access to the scroll compartment but not to the gift compartment.

3. A greeting card and gift set as claimed in claim 2 wherein the access means comprises a hinged flap that has means for inhibiting opening.

4. A combined greeting and gift set as claimed in claim 2, wherein the container is of elongate rectangular configuration and defines first and second separate gift compartments disposed respectively at opposite first and second longitudinal ends of the scroll compartment.

5. A combined greeting and gift set as claimed in claim 4, wherein the respective gift compartments can be accessed from ends of the container or via further flaps in side or front walls.

6. A combined greeting card and gift set comprising a greetings scroll carrying printed matter and having a region for the insertion of a personal message by a user, means for releasably maintaining the scroll in a rolled-up condition and enabling the scroll to be unraveled and re-rolled, a container for housing the scroll and at least one gift, the container being at least partially transparent to enable the scroll and gift to be seen from the outside of the container and having access means which are openable and closable for enabling the scroll to be selectively removed and returned to the container without displacing the gift, wherein the container is formed from transparent plastics sheet containing cuts, or perforations, forming a liftable flap which enables access to a scroll compartment of the container.

7. A combined greeting card and gift set as claimed in claim 1, wherein the container houses a plurality of gifts and a base of the container has an aperture to enable the scroll to be selectively removed from, and replaced to, a position amongst or adjacent the gifts in the container.

8. A combined greeting card and gift set as claimed in claim 1 wherein the scroll is mounted on a plinth.

9. A combined greeting card and gift set as claimed in claim 8, wherein the plinth is formed of stiff paper, cardboard or a plastics material.

10. A greeting card and gift set as claimed in claim 1, where the scroll is made of paper, parchment or card printed with a greeting that can be seen when the scroll is rolled-up and one or more regions receiving personal messages which are not normally viewable when the scroll is rolled up.

11. A greeting card and gift set as claimed in claim 1, wherein the scroll is held in its rolled up condition by a ring which can slide along the scroll to avoid obscuring the personal message and for enabling the scroll to be unravelled and re-rolled.

12. A greeting card and gift set as claimed in claim 11, wherein the ring has a square, triangular or octagonal shape to assist in preventing the scroll from rolling and thereby possibly obscuring the message.

13. A greeting card and gift set as claimed in claim 11, wherein the ring has a circular shape, rolling of the scroll within its compartment being prevented by decoration extending out from the ring.

14. A greeting card and gift set comprising a greetings scroll carrying printed matter and having a region for the insertion of a personal message by the user, means for releasably maintaining the scroll in its rolled-up condition and enabling the scroll to be unraveled and re-rolled, a container for housing the scroll and at least one gift, the container being at least partially transparent to enable the scroll and gift to be seen from the outside of the container and having means which are openable and closable for enabling the scroll to be selectively removed and returned to the container without displacing the gift, and a pull-out card removably housed within a part of the container and being selectively withdrawable to enable writing to be applied thereto to enable the recipient of the greeting card and gift set to be identified.

15. A greeting card and gift-set as claimed in claim 14 wherein the pull-out card has a pull-out tab to assist in enabling it to be withdrawn.

16. A combined greeting and gift set as claimed in claim 14, wherein the container is formed with an internal compartment for the scroll and at least one internal compartment for the gift that is separate from the compartment for the scroll, said access means comprising a raisable flap or a hinged door formed in a wall of the internal compartment for the scroll to enable access to the scroll compartment without providing access to the gift compartment.

17. A combined greeting and gift set as claimed in claim 14, wherein the container is of elongate rectangular configuration and defines a separate gift compartment at each end of a longitudinally extending scroll-containing compartment.

18. A greeting card and gift set as claimed in claim 14, where the scroll is made of paper, parchment or card printed with a greeting that can be seen when the scroll is rolled-up and one or more regions receiving personal messages which are not viewable when the scroll is rolled up.

19. A greeting card and gift set as claimed in claim 14, wherein the scroll is held in its rolled up condition by a ring which can slide along the scroll to avoid obscuring the personal message and for enabling the scroll to be unravelled and re-rolled.

20. A combined greeting and gift set as claimed in claim 2, wherein the access means comprises a raisable flap or hinged door formed in a wall of the scroll compartment of the container.

21. A combined greeting and gift set as claimed in claim 1, wherein the access means comprises a raisable flap or hinged door formed in a wall of the container.

* * * * *